US012092358B2

(12) United States Patent
Zhang

(10) Patent No.: US 12,092,358 B2
(45) Date of Patent: Sep. 17, 2024

(54) FRESH AIR ASSEMBLY, AIR CONDITIONER INDOOR UNIT, AND AIR CONDITIONER

(71) Applicants: GD MIDEA AIR-CONDITIONING EQUIPMENT CO., LTD., Foshan (CN); MIDEA GROUP CO., LTD., Foshan (CN)

(72) Inventor: Huajun Zhang, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 406 days.

(21) Appl. No.: 17/429,181

(22) PCT Filed: Oct. 22, 2019

(86) PCT No.: PCT/CN2019/112434

§ 371 (c)(1),
(2) Date: Aug. 6, 2021

(87) PCT Pub. No.: WO2020/173104

PCT Pub. Date: Sep. 3, 2020

(65) Prior Publication Data

US 2022/0196281 A1 Jun. 23, 2022

(30) Foreign Application Priority Data

Feb. 27, 2019 (CN) ..... 201920253412.4

(51) Int. Cl.
*F24F 13/20* (2006.01)
*F24F 1/0022* (2019.01)
(Continued)

(52) U.S. Cl.
CPC ..... *F24F 13/20* (2013.01); *F24F 1/0022* (2013.01); *F24F 1/0035* (2019.02); *F24F 13/32* (2013.01);
(Continued)

(58) Field of Classification Search
CPC ..... F01P 5/06; F01P 2070/50; F24F 1/0035; F24F 13/20
See application file for complete search history.

(56) References Cited

U.S. PATENT DOCUMENTS

2018/0066569 A1* 3/2018 Shi ..... F01P 11/10
2018/0142906 A1 5/2018 Wu et al.
(Continued)

FOREIGN PATENT DOCUMENTS

CN 203869190 U * 10/2014
CN 204006424 U * 12/2014
(Continued)

OTHER PUBLICATIONS

Translation of Chinese Patent Document CN204718009U entitled TRANSLATION-CN204718009U (Year: 2023).*
(Continued)

*Primary Examiner* — Paul Alvare
(74) *Attorney, Agent, or Firm* — Anova Law Group, PLLC

(57) ABSTRACT

A fresh air assembly includes a fresh air housing including a mounting holder. A clamp space is formed at the mounting holder. A surface of the mounting holder away from the clamp space is provided with a reinforcement rib. The fresh air assembly further includes a fresh air motor mounted in the clamp space.

19 Claims, 5 Drawing Sheets

(51) Int. Cl.

| | |
|---|---|
| ***F24F 1/0035*** | (2019.01) |
| ***F24F 13/30*** | (2006.01) |
| ***F24F 13/32*** | (2006.01) |
| *F01P 5/06* | (2006.01) |

(52) U.S. Cl.

CPC ..... *F01P 5/06* (2013.01); *F01P 2070/50* (2013.01); *F24F 2013/205* (2013.01); *F24F 13/30* (2013.01)

(56) References Cited

U.S. PATENT DOCUMENTS

| | | | | |
|---|---|---|---|---|
| 2021/0003065 | A1* | 1/2021 | Cremering | F01P 3/18 |
| 2022/0243640 | A1* | 8/2022 | Nonaka | F01P 5/06 |

FOREIGN PATENT DOCUMENTS

| | | | | | |
|---|---|---|---|---|---|
| CN | 204718009 | U | * | 10/2015 | |
| CN | 205048578 | U | | 2/2016 | |
| CN | 205536270 | U | | 8/2016 | |
| CN | 105953395 | A | * | 9/2016 | |
| CN | 106642345 | A | | 5/2017 | |
| CN | 106678972 | A | | 5/2017 | |
| CN | 106765847 | A | * | 5/2017 | F24F 1/0003 |
| CN | 107036160 | A | | 8/2017 | |
| CN | 108758820 | A | * | 11/2018 | F04D 29/66 |
| CN | 109489123 | A | | 3/2019 | |
| CN | 209181086 | U | | 7/2019 | |
| CN | 209181091 | U | | 7/2019 | |
| CN | 209181092 | U | | 7/2019 | |
| CN | 209181093 | U | | 7/2019 | |
| CN | 209181118 | U | | 7/2019 | |
| CN | 209181211 | U | | 7/2019 | |
| CN | 209181235 | U | | 7/2019 | |
| CN | 209181239 | U | | 7/2019 | |
| CN | 209325952 | U | | 8/2019 | |
| CN | 209445554 | U | | 9/2019 | |
| DE | 102012017202 | A1 | * | 3/2014 | F01P 11/10 |
| EP | 3739179 | A1 | * | 11/2020 | |
| JP | S6132600 | U | | 2/1986 | |
| JP | 2007153244 | A | | 6/2007 | |
| JP | 2009108714 | A | | 5/2009 | |
| KR | 20080089975 | A | * | 10/2008 | |
| KR | 20090002738 | A | | 1/2009 | |
| WO | 0114800 | A1 | | 3/2001 | |
| WO | 2001014800 | A1 | | 3/2001 | |
| WO | 2007074952 | A2 | | 7/2007 | |
| WO | WO-2019227910 | A1 | * | 12/2019 | F24F 13/224 |
| WO | WO-2020077767 | A1 | * | 4/2020 | H02K 5/00 |

OTHER PUBLICATIONS

Japan Patent Office (JPO) The Notice of Reasons for Refusal For JP Application No. 2019-563735 Jan. 13, 2022 7 Pages (Translation Included).

Japan Patent Office (JPO) The Decision to Grant a Patent For JP Application No. 2019-563735 Jun. 30, 2022 5 Pages (Translation Included).

Canadian Intellectual Property Office The Office Action For CA Application No. 3129462 Dec. 12, 2022 4 Pages.

World Intellectual Property Organization (WIPO) International Search Report and Written Opinion for PCT/CN2019/112434 Jan. 21, 2020 16 pages (with translation).

Japan Patent Office (JPO) The Office Action For JP Application No. 2019-563735 Jun. 8, 2021 6 Pages (Translation Included).

The European Patent Office (EPO) Extended Search Report for EP Application No. 19798154.1 May 7, 2020 8 Pages.

* cited by examiner

FRESH AIR ASSEMBLY, AIR CONDITIONER INDOOR UNIT, AND AIR CONDITIONER

CROSS-REFERENCE TO RELATED APPLICATION APPLICATIONS

This application is a National Stage Entry under 35 U.S.C. § 371 of International Application No. PCT/CN2019/112434, filed on Nov. 22, 2019, which claims priority to Chinese Application No. 201920253412.4, filed on Feb. 27, 2019, and entitled "FRESH AIR ASSEMBLY, AIR CONDITIONER INDOOR UNIT, AND AIR CONDITIONER." The entire disclosures of the aforementioned applications are incorporated herein by reference.

TECHNICAL FIELD

The present disclosure relates to the field of air conditioner, and more particularly relates to a fresh air assembly, an air conditioner indoor unit, and an air conditioner.

BACKGROUND

A household wall-mounted air conditioner is capable of performing heat exchange on indoor air. If the wall-mounted air condition is operated in a confined room for a long time, and the indoor air is not refreshed with outdoor air during the operation, users are prone to negative physiological responses. The current air conditioner is typically provided with a fresh air assembly for air ventilation or air purification. However, due to an unstable mounting structure of a motor for driving a fan in the fresh air assembly, there may occur a relatively large vibration of the fresh air assembly and an accompanying unpleasant noise, which affects user experience.

The description in this section merely provides background information related to the present disclosure and does not necessarily constitute prior art.

SUMMARY

The main objective of the present disclosure is to provide a fresh air assembly, an air conditioner indoor unit, and an air conditioner, aiming to decrease the vibration of the fresh air assembly and the accompanying noise.

In order to achieve the above objective, the present disclosure provides a fresh air assembly, including:

- a fresh air housing, including a mounting holder, where the mounting holder has a clamp space, and a surface of the mounting holder away from the clamp space is provided with a reinforcement rib; and
- a fresh air motor, mounted in the clamp space.

In an embodiment of the present disclosure, the fresh air housing includes a main body, the mounting holder is disposed at a middle portion of the main body; an edge of the main body is provided with a protrusion edge; and the reinforcement rib is configured to extend from a center of the mounting holder to an edge of the fresh air housing, and connected to the protrusion edge.

In an embodiment of the present disclosure, the middle portion of the main body includes an avoidance hole. The mounting holder includes: a frame, bending from an edge of the avoidance hole toward a center of the avoidance hole; and a base, fastened to the frame to enclose the clamp space. The reinforcement rib is disposed on surfaces of the frame and the main body away from the clamp space.

In an embodiment of the present disclosure, the reinforcement rib is one of a plurality of reinforcement ribs, and the plurality of reinforcement ribs are evenly arranged along a circumferential direction of the frame.

In an embodiment of the present disclosure, the reinforcement rib is sheet-shaped and disposed perpendicular to a surface of the frame.

In an embodiment of the present disclosure, the frame includes a plurality of spaced apart support strips, bending from an edge of the avoidance hole toward a center of the avoidance hole. The reinforcement rib is one of a plurality of reinforcement ribs, two of the plurality of reinforcement ribs are disposed in parallel and are disposed on two sides in a width direction of one of the support strips.

In an embodiment of the present disclosure, each two of the plurality of reinforcement ribs are provided with a protrusion rib therebetween; and the protrusion rib is configured to extend from a center of the avoidance hole toward an edge of the avoidance hole.

In an embodiment of the present disclosure, at least one of the plurality of reinforcement ribs has a stair-step structure in an extension direction from a center of the frame toward an edge of the frame.

The present disclosure further provides an air conditioner indoor unit. The indoor unit includes a fresh air assembly as described in any of the above embodiments.

The present disclosure further provides an air conditioner. The air conditioner includes an indoor unit described in any of the above embodiments, and an outdoor unit connected to the indoor unit.

In accordance with the fresh air assembly provided herein, the overall structure of the mounting holder is strengthened by arranging the reinforcement rib thereon, and thus the mounting holder can be prevented from a relatively large deformation caused by the vibration of the fresh air motor. As such, the noise generated by the fresh air assembly during operation can be abated, which improves user experience. In addition, the arrangement of the reinforcement rib can prolong the service life of the fresh air housing, thereby ensuring a stable operation of the fresh air motor, and improving the performance of the fresh air assembly.

BRIEF DESCRIPTION OF THE DRAWINGS

In order to illustrate the technical solution in the embodiments of the present disclosure or the existing technologies more clearly, a brief description will be made below of the drawings referred to in the present disclosure or the existing technologies. It is appreciated that the drawings in the following description are merely some embodiments of the present disclosure, and those skilled in the art could obtain other drawings according to the structures shown in the drawings without any creative efforts.

DESCRIPTION OF REFERENCE NUMERALS

Figure 1:
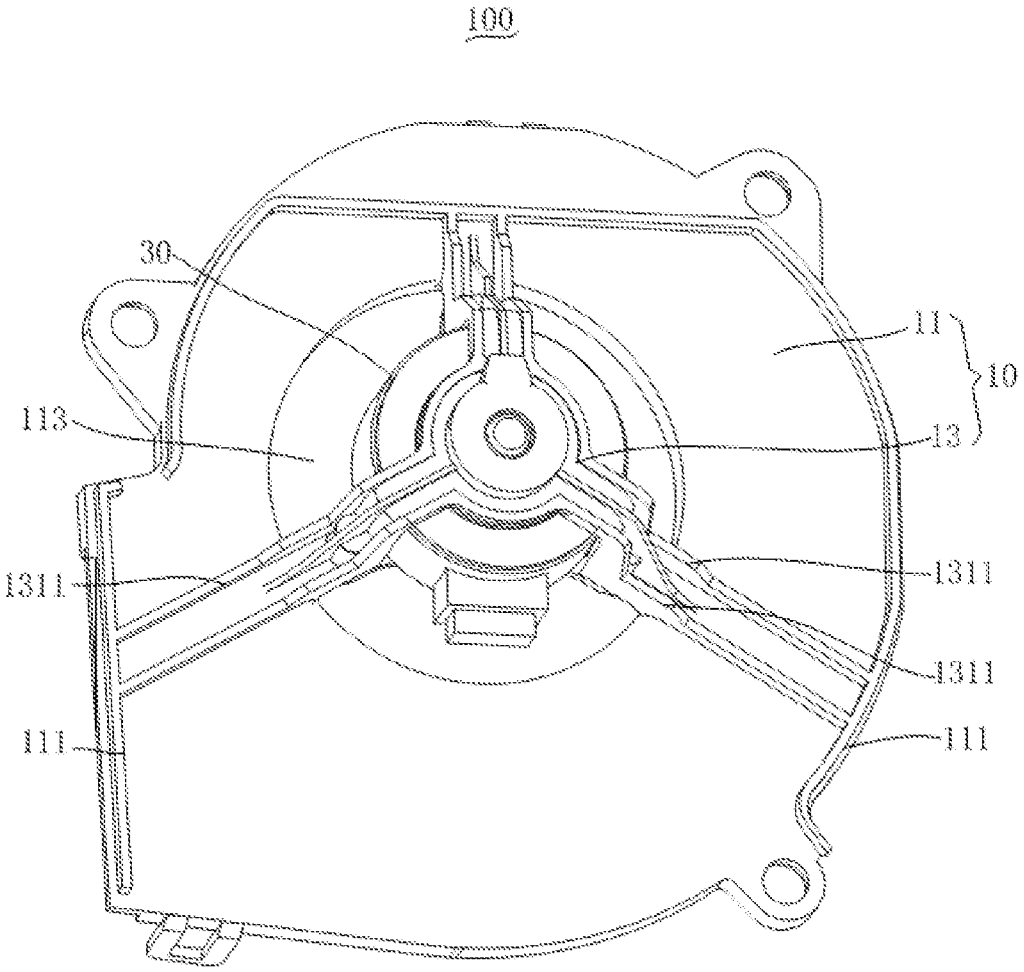
FIG. 1 is a schematic structural diagram of a fresh air assembly according to an embodiment of the present disclosure.

| Reference numeral | Name | Reference numeral | Name |
|---|---|---|---|
| 100 | fresh air assembly | 1313 | support strip |
| 10 | fresh air housing | 1313a | mounting hole |
| 11 | main body | 1313b | positioning block |
| 111 | protrusion edge | 1315 | protrusion rib |
| 113 | avoidance hole | 133 | base |
| 13 | mounting holder | 1331 | connection lug |
| 13a | clamp space | 1333 | connection hole |
| 131 | frame | 1335 | positioning groove |
| 1311 | reinforcement rib | 30 | fresh air motor |

The realization of the objective, functional characteristics, and advantages of the present disclosure are further described with reference to the accompanying drawings.

DETAILED DESCRIPTION OF THE EMBODIMENTS

The technical solutions of the embodiments of the present disclosure will be described in more detail below with reference to the accompanying drawings. It is obvious that the embodiments to be described are only some rather than all of the embodiments of the present disclosure. All other embodiments obtained by persons skilled in the art based on the embodiments of the present disclosure without creative efforts shall fall within the scope of the present disclosure.

It will be appreciated that, all directional indications (such as up, down, left, right, front, rear . . . ) in the embodiments of the present disclosure are only used to explain the relative positional relationship, motion, and the like, between components in a certain posture. If the particular posture changes, the directional indication changes accordingly.

In the present disclosure, unless otherwise clearly specified and limited, the terms "connected," "fixed," etc. should be interpreted broadly. For example, "fixed" can be a fixed connection, a detachable connection, or a whole; can be a mechanical connection or an electrical connection; can be directly connected, or indirectly connected through an intermediate medium, and can be the internal communication between two elements or the interaction relationship between two elements, unless specifically defined otherwise. For those of ordinary skill in the art, the specific meaning of the above-mentioned terms in the present disclosure can be understood according to specific circumstances.

In addition, terms such as "first" and "second" are used herein for purposes of description and are not intended to indicate or imply relative importance or to imply the number of indicated technical features. Thus, the features associated with "first" and "second" may comprise or imply at least one of these features. The technical solutions between the various embodiments can be combined with each other, but they must be based on the realization of those of ordinary skill in the art. When the combination of technical solutions is contradictory or cannot be achieved, it should be considered that such a combination of technical solutions does not exist, nor is it within the scope of the present disclosure.

The present disclosure provides a fresh air assembly 100.

In an embodiment of the present disclosure, as shown in FIGS. 1 to 4, the fresh air assembly 100 includes:

a fresh air housing 10, including a mounting holder 13, where the mounting holder 13 has a clamp space 13*a*; and a fresh air motor 30, mounted in the clamp space 13*a;* a surface of the mounting holder 13 away from the clamp space 13*a* is provided with a reinforcement rib 1311.

In this embodiment, the fresh air assembly 100 is typically mounted in an air conditioner indoor unit, and configured to vent fresh air into indoor room. The built-in structure of the fresh air assembly 100 is both beautiful and convenient to use. The indoor unit herein may be a wall-mounted type or a cabinet type, which is not limited herein. It will be appreciated that the fresh air assembly 100 may also be used separately.

Specifically, the fresh air housing 10 has a fresh air cavity, and is also provided with a fresh air outlet and a fresh air inlet both communicated with the fresh air cavity. In addition, a fresh air tube is connected to the fresh air inlet, so as to communicate the outdoor environment and the fresh air cavity. The fresh air assembly 100 further includes a fresh air fan for inhaling and outputting air. The fresh air fan is mounted in the fresh air cavity, and configured to drive the outdoor air into the fresh air cavity, and then output the air into the indoor room through the fresh air outlet, so as to realize indoor air purification. The fresh air motor 30 for driving the fresh air fan is mounted in the mounting holder 13 and connected to the fresh air fan via a rotating shaft. Correspondingly, the mounting holder 13 is provided with a shaft hole through which the rotating shaft passes. The mounting holder 13 may be integrally formed with other parts of the fresh air housing 10, or may be a separate structure and connected fixedly or detachably with other parts. The clamp space 13*a* is adapted to the fresh air motor 30 for a stable mounting. The surface of the mounting holder 13 away from the clamp space 13*a* is provided with one or more reinforcement ribs 1311. The reinforcement rib 1311 may be in a form of a block, a strip or the like. In addition, the reinforcement rib 1311 may be integrally formed with the mounting holder 13, in order to effectively strengthen the overall structure of the mounting holder 13.

In accordance with the fresh air assembly 100 herein, the overall structure of the mounting holder 13 is strengthened by arranging the reinforcement rib 1311 thereon, and thus the mounting holder 13 can be prevented from a relatively large deformation caused by the vibration of the fresh air motor 30. As such, the noise generated by the fresh air assembly 100 during the operation can be abated, which improves user experience. In addition, the arrangement of the reinforcement rib 1311 can prolong the service life of the fresh air housing 10, thereby ensuring a stable operation of the fresh air motor 30, and improving the performance of the fresh air assembly 100.

Figure 4:
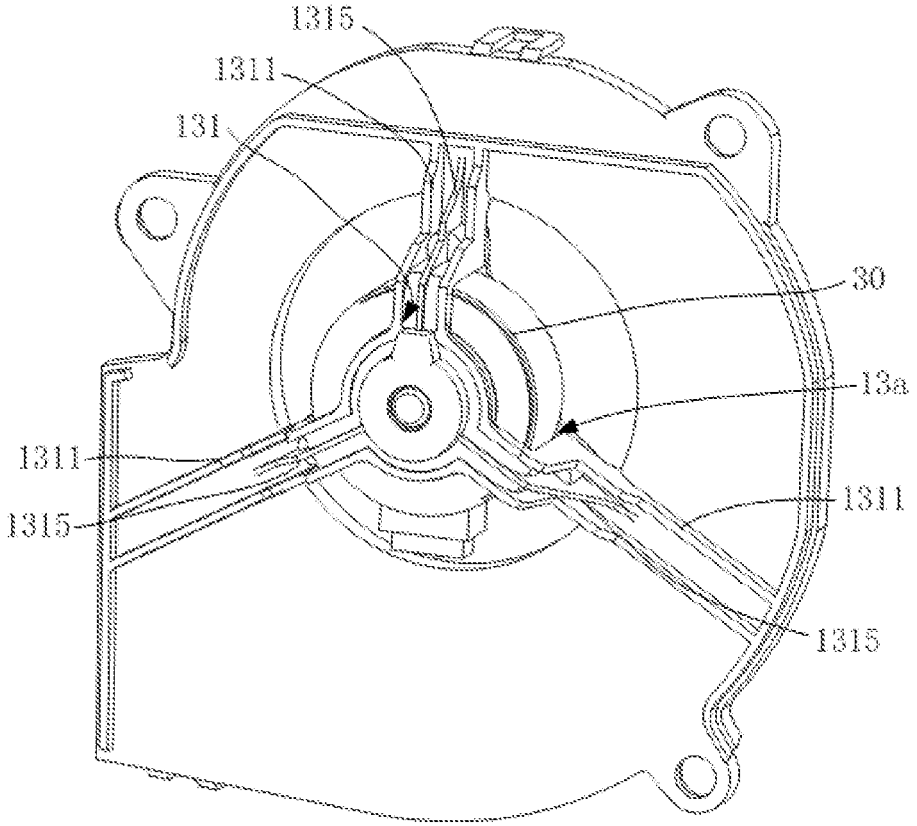
FIG. 4 is a schematic structural diagram of the fresh air assembly in FIG. 1 in another perspective.
Figure 5:
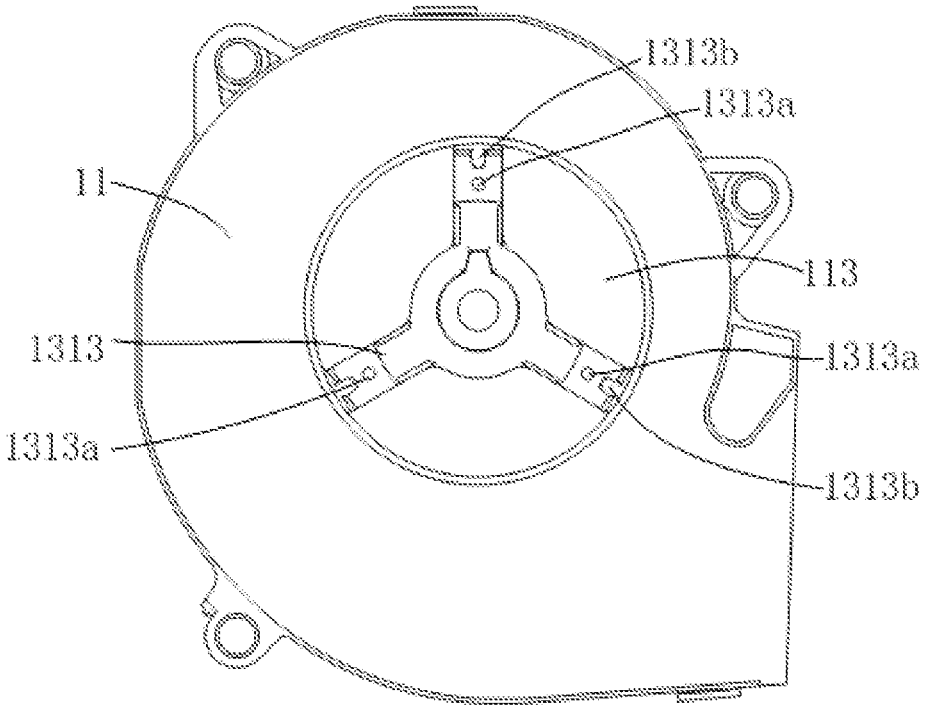
FIG. 5 is a schematic structural diagram of a fresh air housing of the fresh air assembly in FIG. 1.

In an embodiment, as shown in FIGS. 1, 4 and 5, the fresh air housing 10 includes a main body 11. The mounting holder 13 is disposed at a middle portion of the main body 11. In addition, a protrusion edge 111 is provided at an edge of the main body 11. The reinforcement rib 1311 is extended from the center of the mounting holder 13 toward the edge of the fresh air housing 10, and connected to the protrusion edge 111.

In this embodiment, the main body 11 is constituted as a part of the fresh air cavity. In a specific structure, the fresh air housing 10 is a split structure, including two detachable parts that can be fastened with each other to form the fresh air cavity, where the main body 11 is one of the parts. The mounting holder 13 is disposed in the middle of the main body 11, such that the fresh air motor 30 can be mounted in the middle of the main body 11, to enhance the structural stability of the fresh air motor 30. The main body 11 is generally in a form of a volute, and formed with a cavity for accommodating the fresh air fan. The fresh air motor 30 can be connected to the fresh air fan correspondingly, when the two parts of the fresh air housing 10 are fastened to form the fresh air cavity. The surface of the main body 11 away from the clamp space 13*a*, namely the surface away from the fresh air cavity, is provided with the protrusion edge 111, to enhance the structural strength. Specifically, the protrusion edge 111 is sheet-shaped and disposed perpendicular to the surface of the main body 11, which further strengthens the stability of the protrusion edge 111 and the main body 11. In another embodiment, the protrusion edge 111 is arranged to extend along the edge of the main body 11 in a form of a cylindrical strip. The protrusion edge 111 may be distributed continuously or at intervals along the edge of the main body 11, as long the protrusion edge 111 is connected to an extended end of the reinforcement rib 1311. The reinforcement rib 1311 disposed on the mounting holder 13 is extended from the center of the main body 11 toward the edge of the main body 11 and abutted against the protrusion edge 111. The reinforcement rib 1311 is also connected with the surface of the main body 11, and thus the reinforcement rib 1311 and the protrusion edge 111 can be formed integrally. The extension direction of the reinforcement rib 1311 is perpendicular to the extension direction of the protrusion edge 111, such that when there occur vibrations of the fresh air motor 30, the protrusion edge 111 can effectively block the deformation of the mounting holder 13 and the reinforcement rib 1311 in the extension direction, which enhances the structural stability of the mounting holder 13. In this embodiment, the main body 11, the mounting holder 13, the reinforcement rib 1311 and the protrusion edge 111 are formed together as an integral structure, which facilitates the processing and significantly improves the strength of the fresh air housing 10.

Figure 3:
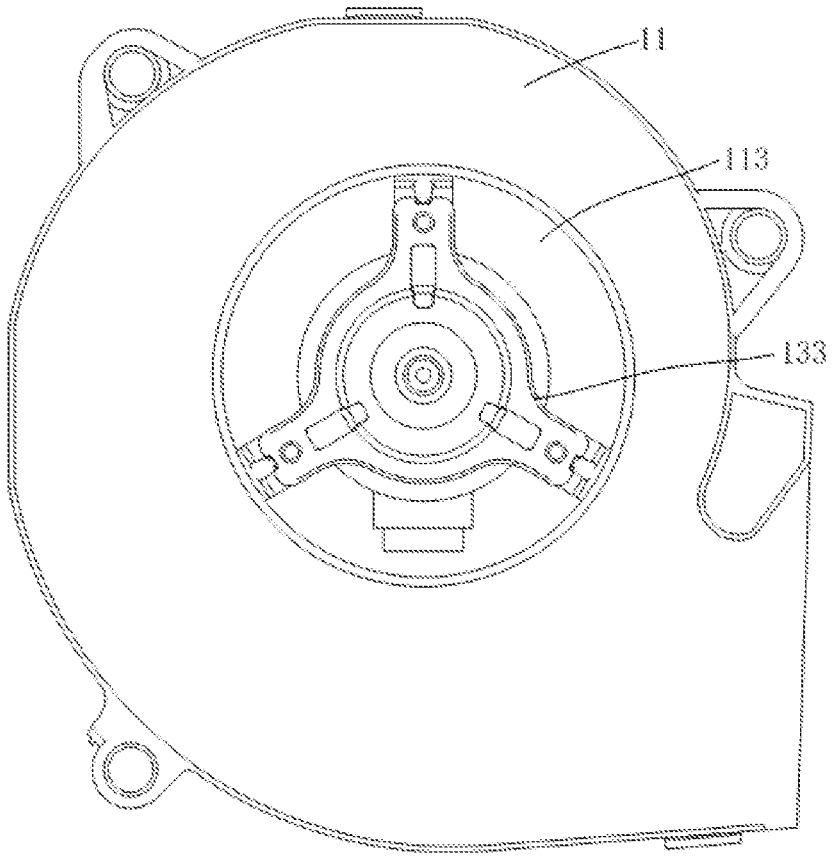
FIG. 3 is a bottom view of the fresh air assembly in FIG. 1.

In an embodiment, as shown in FIGS. 1 and 3, the middle portion of the main body 11 is provided with an avoidance hole 113. The mounting holder 13 includes a frame 131 and a base 133. The frame 131 is configured to bend from the edge of the avoidance hole 113 toward the center of the avoidance hole 113. The base 133 is fastened to the frame 131 and the two cooperatively enclose to form the clamp space 13*a*. The reinforcement ribs 1311 are disposed on the surfaces of the frame 131 and the main body 11 away from the clamp space 13*a*.

In this embodiment, in order to facilitate the mounting of the fresh air motor 30, the mounting holder 13 includes the frame 131 and the base 133 detachably connected with each other. The frame 131 bends from the main body 11 toward the center of the avoidance hole 113, so as to form a space for accommodating the fresh air motor 30. The base 133 is fastened to the frame 131 to form the clamp space 13*a*. The connection of the base 133 and the frame 131 may be a screw connection, a buckle connection, or a plug connection or the like. In this embodiment, the frame 131 and the base 133 are in a threaded connection for the purpose of stability. Because the frame 131 is integrally formed with the main body 11, and the fresh air motor 30 is accommodated in the frame 131, the reinforcement rib 1311 on the frame 131 can improve the structural stability of the mounting holder 13, thereby improving the overall stability of the fresh air assembly 100.

Figure 2:
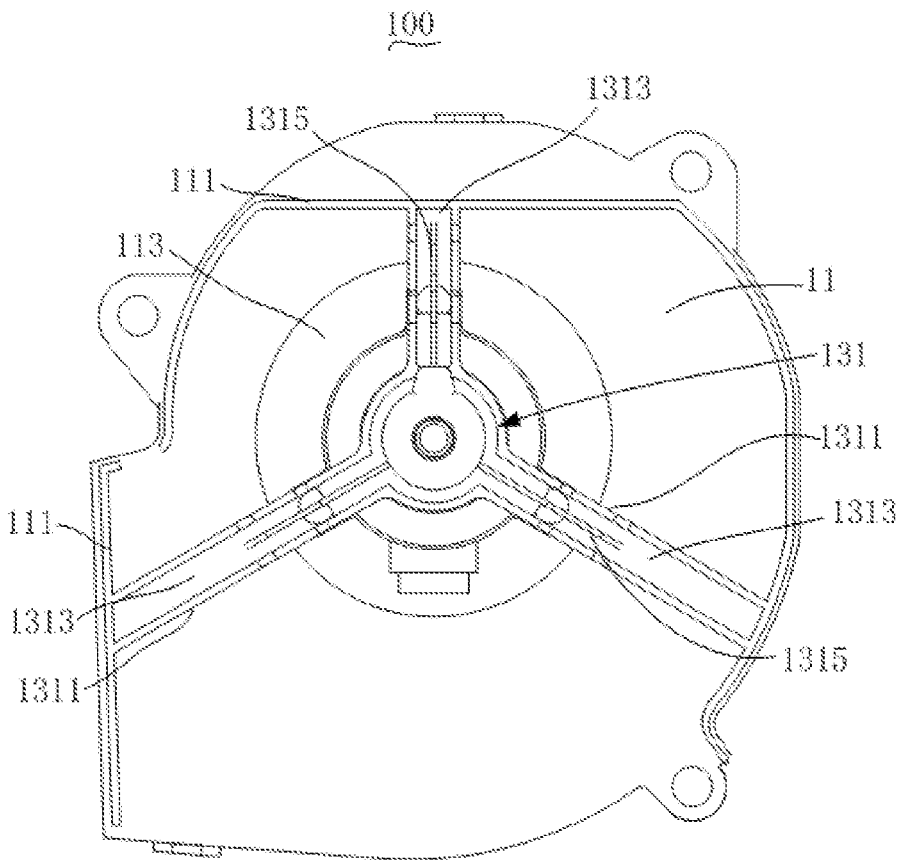
FIG. 2 is a front view of the fresh air assembly in FIG. 1.

In an embodiment, as shown in FIG. 2, the reinforcement ribs 1311 are provided in plurality. The plurality of reinforcement ribs 1311 are evenly arranged along the circumferential direction of the frame 131.

In this embodiment, the reinforcement ribs 1311 are provided in plurality, such as two or more than two. The plurality of reinforcement ribs 1311 can further improve the structural stability of the mounting holder 13. In addition, the plurality of reinforcement ribs 1311 are evenly arranged along the circumferential direction of the frame 131, thus the strength of each part of the frame 131 can be enhanced. As such, the stress concentration due to the vibration of the frame 131 with uneven structural strength can be prevented, thereby improving uniformity of the structural strength.

In an embodiment, the reinforcement rib 1311 is sheet-shaped and disposed perpendicular to the surface of the frame 131.

In this embodiment, the reinforcement rib 1311 is sheet-shaped, of which the thickness may be selected according to the thickness of the main body 11. For example, the thickness of the reinforcement rib 1311 is consistent with the thickness of the main body 11. The sheet-shaped reinforcement rib 1311 is disposed perpendicular to the surface of the frame 131, and according to the principle of force superposition, the deformations of the main body 11 and the frame 131 can be effectively reduced, to decrease the vibration frequency of the mounting holder 13, thereby improving the stability of the fresh air motor 30 and thus suppressing the generation of noise.

In an embodiment, the frame 131 includes a plurality of support strips 1313 spaced apart. The reinforcement ribs 1311 are provided in plurality, and two of the reinforcement ribs 1311 are disposed in parallel and respectively on two sides in a width direction of one support strip 131.

In this embodiment, in order to facilitate the mounting of the fresh air motor 30 and heat dissipation, the frame 131 has the plurality of support strips 1313 spaced apart, such that a heat dissipation space is formed between each two of the support strips 1313, thereby improving the performance of the fresh air motor 30 and the heat dissipation. Each of the support strips 1313 is configured to bend from the edge of the avoidance hole 113 to the center of the avoidance hole 113. The reinforcement ribs 1311 are provided in plurality, and at least two of the reinforcement ribs 1311 are disposed in the width direction perpendicular to the extension direction of the support strip 1313, in order to increase the structural strength of the support strip 1313, thereby ensuring the mounting stability of the frame 131. Specifically, the support strips 1313 are three, and the three support strips 1313 are evenly arranged along the circumferential direction of the avoidance hole 113, so as to implement the even arrangement of the reinforcement ribs 1311, thereby realizing material savings in case of the guaranteed strength. The base 133 is provided with three connection lugs 1331, and each of the connection lugs 1331 is provided with a connection hole 1333. Correspondingly, the three support strips 1313 are provided with mounting holes 1313*a*. By this way, a screw connection can be used between the connection hole 1333 and the mounting hole 1313*a*, to realize a stable mounting.

Figure 6:
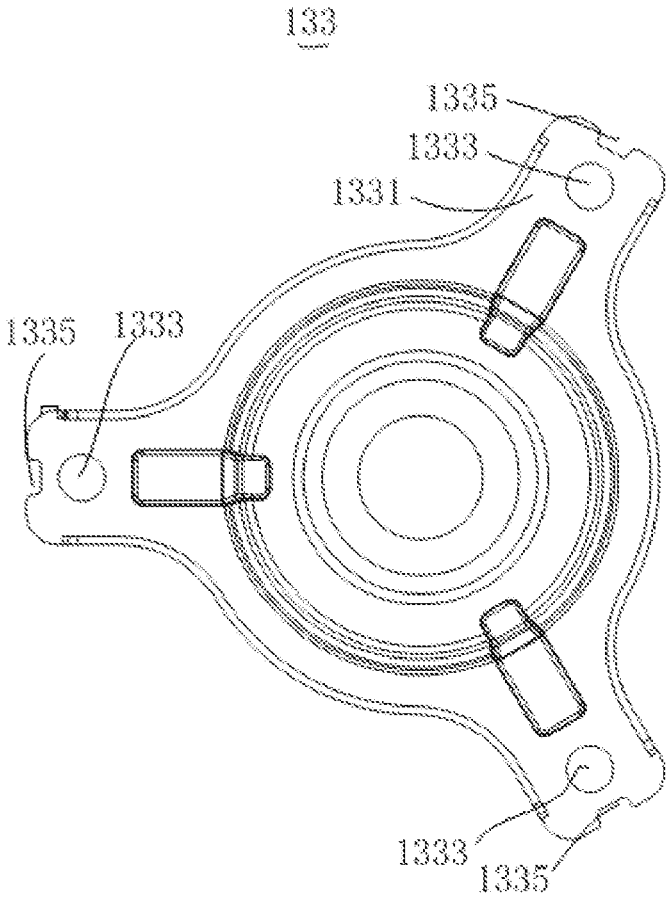
FIG. 6 is a schematic structural diagram of a base of the fresh air assembly in FIG. 1.

In addition, as shown in FIGS. 5 and 6, in order to facilitate the mounting of the base 133 and the frame 131, the base 133 is provided with a positioning groove 1335 at an end of the connection lug 1331, and an end of the support strip 1313 is provided with a positioning block 1313*b*. The cooperation of the positioning groove 1335 with the positioning block 1313*b* allows the base 133 to be relatively fixed to the frame 131, so as to facilitate the screw connection, thereby improving the assembly efficiency.

In an embodiment, as shown in FIG. 4, each two of the reinforcement ribs 1311 is provided with a protrusion rib 1315 therebetween. The protrusion rib 1315 is configured to extend from the center of the frame 131 to the edge of the frame 131.

In this embodiment, in order to further enhance the structural strength of the frame 131, the protrusion rib 1315 is disposed between the two reinforcement ribs 1311 of each support strip 1313. The protrusion rib 1315 may be integrally formed with the support strip 1313. In addition, the protrusion rib 1315 may be sheet-shaped and disposed perpendicular to the surface of the support strip 1313, of which the thickness may be smaller than the thickness of the reinforcement rib 1311. The protrusion rib 1315 extends from the center of the frame 131 toward the edge of the frame 131, and a length of the extension direction of the protrusion rib 1315 may be smaller than that of the reinforcement rib 1311, so as to facilitate the processing of the protrusion rib 1315, and further strengthen the frame 131 combined with the reinforcement rib 1311.

In an embodiment, at least one of the reinforcement ribs 1311 has a stair-step structure in an extension direction from the center of the frame 131 toward the edge of the frame 131.

In this embodiment, the support strip 1313 bends in its extension direction, which forms a certain stair step structure. The reinforcement rib 1311 may have a uniform or non-uniform height perpendicular to the support strip 1313 in its extension direction. The reinforcement rib 1311 may also have a stair-step structure in its extension direction. The stair-step structure of the reinforcement rib 1311 may match with the stair-step structure of the support strip 1313. Alternatively, the stair-step structure of the reinforcement rib 1311 may be formed at a portion in contact with the main body 11. The reinforcement rib 1311 with the stair-step structure can further strength itself. In addition, the stair-step structure formed in the direction perpendicular to the extension direction can effectively block the softness in the extension direction and thus improve the stiffness, which strengthens the overall structural strength of the support strip 1313 and the frame 131, further improving the stability of the fresh air motor 30.

The present disclosure further provides an air conditioner indoor unit (not shown), including a fresh air assembly 100 as described in above embodiments. The specific structure of the indoor unit may refer to any of the above embodiments. It will be appreciated that since the indoor unit herein adopts all the technical solutions of the above embodiments, thus can achieve all the technical effects introduced by the above embodiments.

In this embodiment, the indoor unit is a device for performing heat exchange on indoor air, such as cooling or heating the air. It will be appreciated that the indoor unit further includes a second housing and a main machine of the indoor unit. The second housing includes but is not limited to components such as a chassis and a face frame. The main machine includes but is not limited to an indoor heat exchanger and a wind wheel. The second housing has an air passage, as well as an air inlet and an air outlet. The wind wheel is disposed in the air passage. During the rotation of the wind wheel, the air is passing through the indoor heat exchanger to enter the air passage and then output through the air outlet.

The fresh air assembly 100 is disposed in the second housing, and side by side with the main machine in the length direction of the second housing, that is, the fresh air housing 10 of the fresh air assembly 100 is arranged side by side with the indoor heat exchanger or the wind wheel, so that the outdoor air circulating in the fresh air cavity does not affect the efficiency of indoor heat exchange. The second housing may have an opening communicated with the fresh air outlet of the fresh air assembly 100, so as to vent fresh air into the indoor room. In other embodiments, the panel of the second housing does not cover the fresh air outlet, and the fresh air outlet directly communicates with the indoor room, thereby effectively improving efficiency of refreshing the air.

The present disclosure also provides an air conditioner (not shown), including an indoor unit and an outdoor unit connected to the indoor unit. The indoor unit includes a second housing, a main machine, and a fresh air assembly 100. The fresh air assembly 100 and the main machine are arranged side by side along the length direction of the second housing. The specific structure of the indoor unit may refer to any of the above embodiments. It will be appreciated that since the indoor unit herein adopts all the technical solutions of the above embodiments, thus can achieve all the technical effects introduced by the above embodiments.

The outdoor unit may be any outdoor unit in the related art.

The foregoing description merely portrays some illustrative embodiments in accordance with the present disclosure and therefore is not intended to limit the patentable scope thereof. Any equivalent structure or flow transformations that are made taking advantage of the specification and accompanying drawings of the present disclosure and any direct or indirect applications thereof in other related technical fields shall all fall in the scope of protection of the present disclosure.

What is claimed is:

1. A fresh air assembly comprising:

a fresh air housing including a main body and a mounting holder disposed at a middle portion of the main body, a clamp space being formed at the mounting holder, a surface of the mounting holder away from the clamp space being provided with a reinforcement rib, an edge of the main body being provided with a protrusion edge, the protrusion edge extending along a straight line; and a fresh air motor mounted in the clamp space;

wherein the surface of the mounting holder away from the clamp space is further provided with a protrusion rib, and the protrusion rib has a stair-step structure with more than one step in an extension direction from a center of the mounting holder toward an edge of the mounting holder.

2. The fresh air assembly of claim 1, wherein:

the reinforcement rib is configured to extend from a center of the mounting holder to an edge of the fresh air housing, and connected to the protrusion edge.

3. The fresh air assembly of claim 2, wherein:

the middle portion of the main body includes an avoidance hole;

the mounting holder includes:

a frame bending from an edge of the avoidance hole toward a center of the avoidance hole; and a base fastened to the frame to enclose the clamp space; and the reinforcement rib is disposed on surfaces of the frame and the main body away from the clamp space.

4. The fresh air assembly of claim 3, wherein the reinforcement rib is one of a plurality of reinforcement ribs evenly arranged along a circumferential direction of the frame.

5. The fresh air assembly of claim 3, wherein the reinforcement rib is sheet-shaped and disposed perpendicular to a surface of the frame.

6. The fresh air assembly of claim 3, wherein:

the frame includes a plurality of support strips spaced apart from each other and bending toward a center of the avoidance hole from an edge of the avoidance hole; and the reinforcement rib is one of a plurality of reinforcement ribs, two of the plurality of reinforcement ribs being disposed in parallel and on two sides, respectively, of one of the support strips in a width direction of the one of the support strips.

7. The fresh air assembly of claim 6, wherein the protrusion rib is provided between two neighboring ones of the plurality of reinforcement ribs and is configured to extend from a center of the avoidance hole toward an edge of the avoidance hole.

8. The fresh air assembly of claim 6, wherein at least one of the plurality of reinforcement ribs has a stair-step structure in an extension direction from a center of the frame toward an edge of the frame.

9. An air conditioner indoor unit comprising:

a fresh air assembly including:

a fresh air housing including a main body and a mounting holder disposed at a middle portion of the main body, a clamp space being formed at the mounting holder, a surface of the mounting holder away from the clamp space being provided with a reinforcement rib, an edge of the main body being provided with a protrusion edge, the protrusion edge extending along a straight line; and a fresh air motor mounted in the clamp space;

wherein the surface of the mounting holder away from the clamp space is further provided with a protrusion rib, and the protrusion rib has a stair-step structure with more than one step in an extension direction from a center of the mounting holder toward an edge of the mounting holder.

10. The air conditioner indoor unit of claim 9, wherein:

the reinforcement rib is configured to extend from a center of the mounting holder to an edge of the fresh air housing, and connected to the protrusion edge.

11. The air conditioner indoor unit of claim 10, wherein:

the middle portion of the main body includes an avoidance hole;

the mounting holder includes:

a frame bending from an edge of the avoidance hole toward a center of the avoidance hole; and a base fastened to the frame to enclose the clamp space; and the reinforcement rib is disposed on surfaces of the frame and the main body away from the clamp space.

12. The air conditioner indoor unit of claim 11, wherein the reinforcement rib is one of a plurality of reinforcement ribs evenly arranged along a circumferential direction of the frame.

13. The air conditioner indoor unit of claim 11, wherein the reinforcement rib is sheet-shaped and disposed perpendicular to a surface of the frame.

14. The air conditioner indoor unit of claim 11, wherein:

the frame includes a plurality of support strips spaced apart from each other and bending toward a center of the avoidance hole from an edge of the avoidance hole; and the reinforcement rib is one of a plurality of reinforcement ribs, two of the plurality of reinforcement ribs being disposed in parallel and on two sides, respectively, of one of the support strips in a width direction of the one of the support strips.

15. The air conditioner indoor unit of claim 14, wherein the protrusion rib is provided between two neighboring ones of the plurality of reinforcement ribs and is configured to extend from a center of the avoidance hole toward an edge of the avoidance hole.

16. An air conditioner comprising:

an indoor unit including:

a fresh air assembly including:

a fresh air housing including a main body and a mounting holder disposed at a middle portion of the main body, a clamp space being formed at the mounting holder, a surface of the mounting holder away from the clamp space being provided with a reinforcement rib, an edge of the main body being provided with a protrusion edge, the protrusion edge extending along a straight line; and a fresh air motor mounted in the clamp space;

wherein the surface of the mounting holder away from the clamp space is further provided with a protrusion rib, and the protrusion rib has a stair-step structure with more than one step in an extension direction from a center of the mounting holder toward an edge of the mounting holder.

17. The fresh air assembly of claim 1, wherein a thickness of the reinforcement rib being different from a thickness of the protrusion rib.

18. The fresh air assembly of claim 17, wherein the thickness of the protrusion rib is less than the thickness of the reinforcement rib.

19. The fresh air assembly of claim 1, wherein the reinforcement rib has a stair-step structure with more than two steps in an extension direction from a center of the mounting holder toward an edge of the mounting holder.

* * * * *